US011735154B2

(12) United States Patent
Karasawa et al.

(10) Patent No.: US 11,735,154 B2
(45) Date of Patent: Aug. 22, 2023

(54) EARPIECE DEVICE

(71) Applicants: Sintai Optical (Shenzhen) Co., Ltd., ShenZhen (CN); Asia Optical Co., Inc., Taichung (TW)

(72) Inventors: Takayuki Karasawa, Taichung (TW); Tomoya Takahashi, Taichung (TW)

(73) Assignees: SINTAI OPTICAL (SHENZHEN) CO., LTD., Shenzhen (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 17/579,692

(22) Filed: Jan. 20, 2022

(65) Prior Publication Data

US 2022/0270585 A1 Aug. 25, 2022

(30) Foreign Application Priority Data

Feb. 20, 2021 (TW) ..... 110105946

(51) Int. Cl.

| | |
|---|---|
| ***H04R 1/02*** | (2006.01) |
| ***H04R 1/10*** | (2006.01) |
| ***G10K 11/30*** | (2006.01) |
| ***H04R 1/28*** | (2006.01) |

(52) U.S. Cl.

CPC ..... *G10K 11/30* (2013.01); *H04R 1/02* (2013.01); *H04R 1/1008* (2013.01); (Continued)

(58) Field of Classification Search

CPC . H04R 1/00; H04R 1/02; H04R 1/025; H04R 1/026; H04R 1/10; H04R 1/1008; (Continued)

(56) References Cited

U.S. PATENT DOCUMENTS 6,356,644 B1 * 3/2002 Pollak ..... H04R 1/1075 181/129
10,080,076 B2 9/2018 Karasawa et al.
(Continued)

FOREIGN PATENT DOCUMENTS

CA 3072978 A1 2/2019
CN 206251312 U 6/2017
(Continued)

OTHER PUBLICATIONS

WO-2021221054-A1, English Translation, Date Nov. 2021.*

*Primary Examiner* — Thang V Tran
(74) *Attorney, Agent, or Firm* — McClure, Qualey & Rodack, LLP

(57) ABSTRACT

An earpiece device includes a housing, a sound generator and a first blocker. The sound generator includes a first loudspeaker which includes a vibrating board. The vibrating board includes a first sound generating surface and a second sound generating surface. The first sound generating surface is disposed towards the exterior of the housing. The second sound generating surface is disposed opposite to the first sound generating surface. The first blocker includes a first portion, a second portion, a first side surface and a second side surface. The first side surface is disposed towards the first sound generating surface. The second side surface is disposed opposite to the first side surface. The first portion is disposed between the first side surface and the second side surface and is fixed to the cover plate. The second portion is disposed opposite to the first portion and is distant from the cover plate.

14 Claims, 5 Drawing Sheets

(52) U.S. Cl.
CPC ..... *H04R 1/1075* (2013.01); *H04R 1/1091* (2013.01); *H04R 1/2803* (2013.01)

(58) Field of Classification Search
CPC .. H04R 1/1058; H04R 1/1075; H04R 1/1091; H04R 1/28; H04R 5/02; H04R 5/0335; G10K 11/30
See application file for complete search history.

(56) References Cited

U.S. PATENT DOCUMENTS

| | | | | |
|---|---|---|---|---|
| 2003/0103637 | A1* | 6/2003 | Huang | H04R 1/1075 381/74 |
| 2004/0218775 | A1* | 11/2004 | Huang | H04R 5/033 381/186 |
| 2016/0029137 | A1* | 1/2016 | Price | H04R 1/2823 29/594 |
| 2017/0366893 | A1 | 12/2017 | Karasawa et al. | |
| 2018/0288518 | A1* | 10/2018 | Schmidt | H04R 1/1066 |
| 2020/0252710 | A1 | 8/2020 | Bottoni et al. | |
| 2022/0132239 | A1 | 4/2022 | Horie | |

FOREIGN PATENT DOCUMENTS

| | | | | |
|---|---|---|---|---|
| CN | 107517420 | A | 12/2017 | |
| CN | 111213387 | A | 5/2020 | |
| CN | 112913257 | A | 6/2021 | |
| DE | 102017118815 | A1 | 2/2019 | |
| EP | 3669554 | A1 | 6/2020 | |
| JP | 2001-339786 | A | 12/2001 | |
| JP | 2008-124676 | A | 5/2008 | |
| JP | 2017-225111 | A | 12/2017 | |
| JP | 2017225111 | A | 12/2017 | |
| JP | 6491256 | B2 | 3/2019 | |
| JP | 2020-088839 | A | 6/2020 | |
| KR | 20200059218 | A | 5/2020 | |
| SG | 11202001322 | S | 3/2020 | |
| TW | M299992 | U | 10/2006 | |
| TW | M458753 | U | 8/2013 | |
| TW | M468116 | U | 12/2013 | |
| TW | 201801539 | A | 1/2018 | |
| TW | I627866 | B | 6/2018 | |
| TW | 201914317 | A | 4/2019 | |
| WO | 2019034656 | A1 | 2/2019 | |
| WO | WO-2021221054 | A1 * | 11/2021 | H04R 1/10 |

* cited by examiner

EARPIECE DEVICE

BACKGROUND OF THE INVENTION

Field of the Invention

The invention relates to an earpiece device, and more particularly to an earpiece device using at least one acoustic lens to improve the quality of sound.

Description of the Related Art

The sound wave generated by a loudspeaker is a spherical wave. When a loudspeaker is used indoors, the curvature of the spherical wave gradually becomes large because the loudspeaker generally is distant from user's ear. That is, the spherical wave upon arrival at user's ear is already close to a plane wave. As for an earpiece device capable of sound positioning in the front, the sound wave upon arrival at user's ear is still in the form of a spherical wave because the earpiece device is located near user's ear. That may change the balance between the high frequency sound and the low frequency sound and affect the quality of sound.

BRIEF SUMMARY OF THE INVENTION

The invention therefore provides an earpiece device using an acoustic lens to delay propagation of the sound wave at the peripheral part thereof so that the sound wave is close to a plane wave when reaching user's ear.

The earpiece device in accordance with an exemplary embodiment of the invention includes a housing, a sound generator and a first blocker. The housing includes a main body and a cover plate, wherein the cover plate includes a first surface and a second surface, the first surface is disposed towards the main body, the second surface is disposed opposite to the first surface, and the first surface is connected to the main body so as to form an internal space of the main body, and to form an exterior which is distant from the main body. The sound generator includes a first loudspeaker, wherein the first loudspeaker includes a vibrating board, the vibrating board includes a first sound generating surface and a second sound generating surface, the first sound generating surface is disposed towards the exterior, and the second sound generating surface is disposed opposite to the first sound generating surface. The first blocker includes a first portion, a second portion, a first side surface and a second side surface, wherein the first side surface is disposed towards the first sound generating surface, the second side surface is disposed opposite to the first side surface, the first portion is disposed between the first side surface and the second side surface, the first portion is fixed to the cover plate, and the second portion is disposed opposite to the first portion and is distant from the cover plate.

In another exemplary embodiment, the sound generator further includes a second loudspeaker and a third loudspeaker, an projected area formed by projecting the second loudspeaker onto the cover plate has a first center, another projected area formed by projecting the third loudspeaker onto the cover plate has a second center, a line connecting the first center and the second center is perpendicularly bisected by a bisector plane, and the bisector plane passes through the first loudspeaker.

In yet another exemplary embodiment, the earpiece device further includes a second blocker, wherein the cover plate further includes a support element, the support element includes an end portion connected to the second surface of the cover plate, the second blocker includes a third portion and a fourth portion, the third portion is fixed to the end portion of the support element, and the fourth portion is disposed opposite to the third portion and is distant from the end portion of the support element.

In another exemplary embodiment, the second blocker is disposed between the first blocker and the vibrating board of the first loudspeaker, the first sound generating surface is disposed towards the first blocker and the second blocker, and the second blocker is disposed closer to the first sound generating surface than the first blocker.

In yet another exemplary embodiment, a ratio of width to height of the first blocker ranges from 2.57 to 3.43, and a ratio of width to height of the second blocker ranges from 2.61 to 3.47.

In another exemplary embodiment, the sound generator further includes a magnetic circuit, the magnetic circuit includes a magnet, the magnet includes a third surface and a fourth surface, the third surface of the magnet is disposed towards the second sound generating surface of the vibrating board, the fourth surface of the magnet is disposed opposite to the third surface of the magnet, and the third surface of the magnet and the first side surface of the first blocker have an included angle less than ninety degrees.

The earpiece device in accordance with yet another embodiment includes a housing, a sound generator and a first blocker. The housing includes a main body and a cover plate, wherein the cover plate defines a first acoustic hole and includes a first surface and a second surface, the first surface is disposed towards the main body, the second surface is disposed opposite to the first surface, and the first surface is connected to the main body so as to form an internal space of the main body, and to form an exterior which is distant from the main body. The sound generator includes a first loudspeaker, wherein the first loudspeaker includes a vibrating board, the vibrating board includes a first sound generating surface and a second sound generating surface, the first sound generating surface is disposed towards the first surface of the cover plate, and the second sound generating surface is disposed opposite to the first sound generating surface. The first blocker is disposed adjacent to the first acoustic hole and includes a first portion, a second portion, a first side surface and a second side surface, wherein the first side surface is disposed close to the first acoustic hole, the second side surface is disposed opposite to the first side surface, the first portion is disposed between the first side surface and the second side surface, the first portion is fixed to the cover plate, and the second portion is disposed opposite to the first portion and is distant from the cover plate.

In another exemplary embodiment, the sound generator further includes a magnetic circuit, the magnetic circuit includes a magnet, the magnet includes a third surface and a fourth surface, the third surface of the magnet is disposed towards the second sound generating surface of the vibrating board, the fourth surface of the magnet is disposed opposite to the third surface of the magnet, and the third surface of the magnet and the first side surface of the first blocker have an included angle equal to or less than ninety degrees.

In yet another exemplary embodiment, a ratio of width to height of the first blocker ranges from 1.33 to 1.78, or ranges from 2.13 to 2.85.

In another exemplary embodiment, the first blocker includes a sound wave blocking plate.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
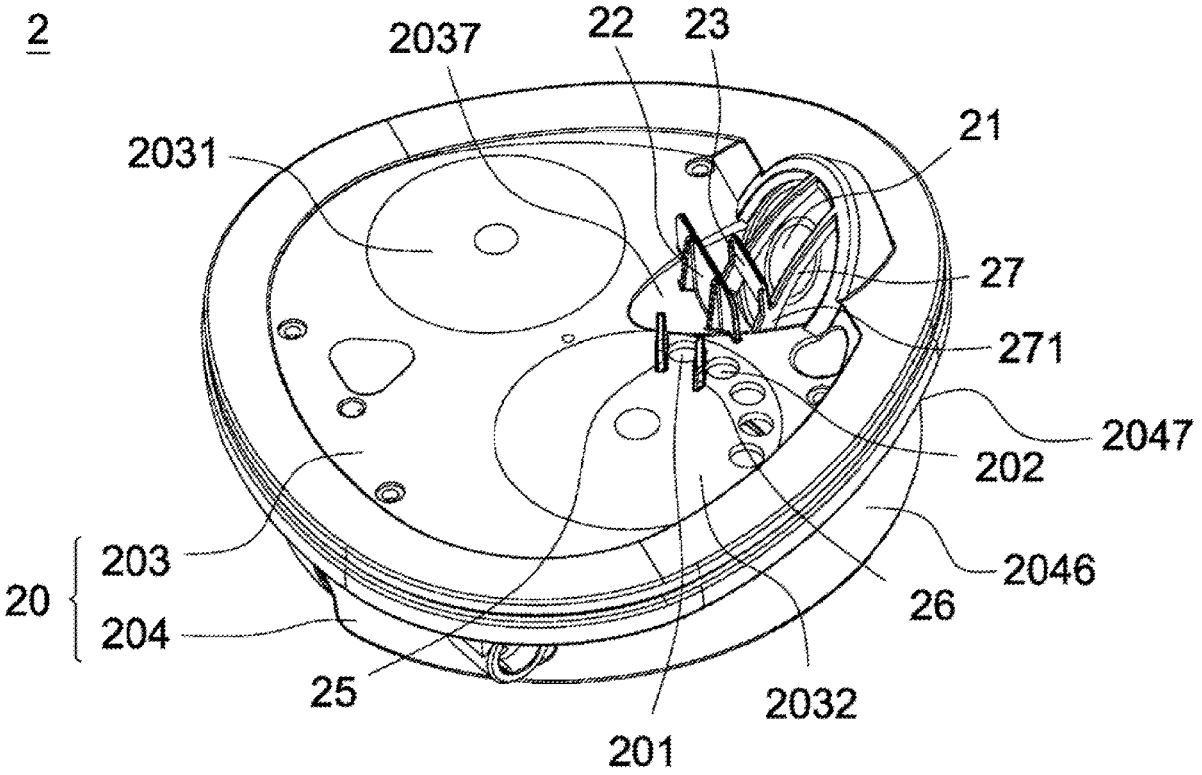
FIG. 1 is a perspective diagram of an earpiece device in accordance with an embodiment of the invention.

Referring to FIG. 1, FIG. 1 is a perspective diagram of an earpiece device in accordance with an embodiment of the invention, wherein the earpiece device 2 includes an ear cushion (not shown), a housing 20, a sound generator, and a plurality of blockers 22, 23, 25 and 26. The ear cushion is connected to the housing 20 and is made of soft material (e.g. sponge) for contacting user's ear. In the invention, the sound generator includes a tweeter 21, a woofer 24 (shown in FIGS. 4 and 5), and a crossfeed loudspeaker (not shown). The blockers 22, 23, 25 and 26 are acoustic lenses, each of which includes a sound wave blocking plate. In use, a sound wave generated by the tweeter 21 sequentially passes by the blocker 23 and the blocker 22 and reaches the ear canal. Also, another sound wave generated by the woofer 24 sequentially passes by the blocker 25 and the blocker 26 and reaches the ear canal. The arrangement and function of the elements of the invention are described below.

Figure 2:
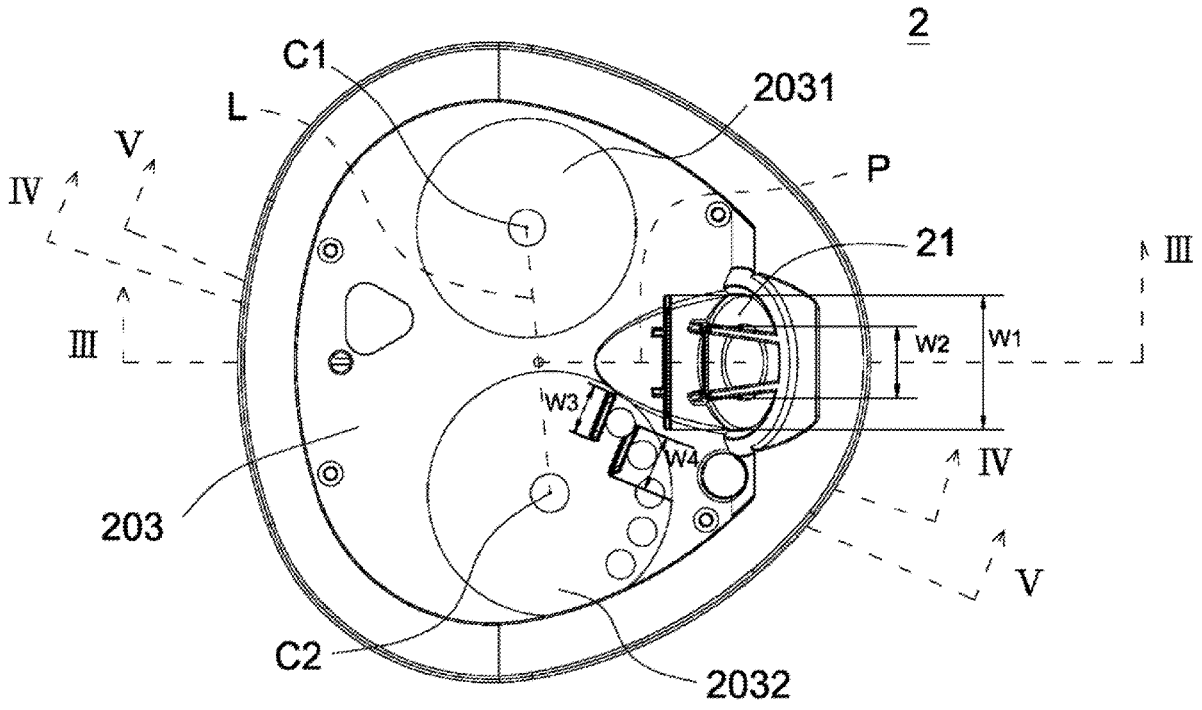
FIG. 2 is a top view of the earpiece device of FIG. 1.
Figure 3:
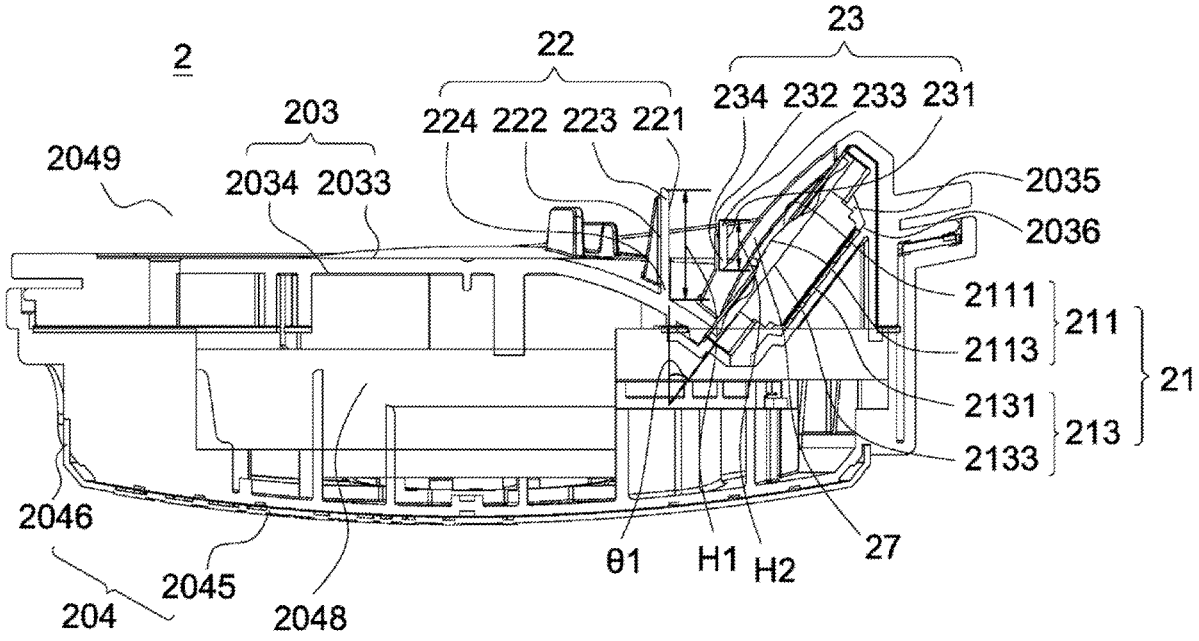
FIG. 3 is a sectional view of the earpiece device of FIG. 2 along III-III.

Referring to FIGS. 1, 2 and 3, FIG. 2 is a top view of the earpiece device of FIG. 1, and FIG. 3 is a sectional view of the earpiece device of FIG. 2 along III-III. As shown, the housing 20 includes a main body 204 and a cover plate 203. The cross section of the main body 204 is substantially U-shaped. The main body 204 includes a bottom portion 2045 and a circumferential portion 2046. A side of the circumferential portion 2046 connected to the bottom portion 2045 is a closed side, while another side opposite to the closed side is an open side. The cover plate 203 is disposed at the open side and includes a first surface 2034 and a second surface 2033. The first surface 2034 is disposed towards the main body 204 and connected to the main body 204 so as to form an internal space 2048 of the housing 20 and to form an exterior 2049 which is distant from the main body 204. The second surface 2033 of the cover plate 203 is disposed opposite to the first surface 2034. The circumferential portion 2046 of the main body 204 is provided with a mounting hole 2047. The earpiece device 2 of the invention further includes an extension support (not shown). The extension support is disposed outside the housing 20 and extends along the circumferential portion 2046 of the main body 204. The extension support has an end connected to the mounting hole 2047.

Referring to FIG. 2, a projected area 2032 formed by projecting the woofer 24 onto the cover plate 203 has a first center C2. Another projected area 2031 formed by projecting the crossfeed loudspeaker (not shown) onto the cover plate 203 has a second center C1. In this embodiment, a line L connecting the first center C2 and the second center C1 is perpendicularly bisected by a bisector plane P, and the bisector plane P passes through the tweeter 21 which is located near the mounting hole 2047.

The tweeter 21 is disposed in the internal space 2048 and includes a vibrating board 211 and a magnetic circuit 213. The vibrating board 211 includes a first sound generating surface 2111 and a second sound generating surface 2113. The first sound generating surface 2111 is disposed towards the exterior 2049 of the main body 204. The second sound generating surface 2113 is disposed opposite to the first sound generating surface 2111, namely the second sound generating surface 2113 is disposed towards the internal space 2048. The magnetic circuit 213 is placed at a side of the vibrating board 211, and the second sound generating surface 2113 is disposed towards the side where the magnetic circuit 213 is placed. The magnetic circuit 213 includes a magnet which has a third surface 2133 and a fourth surface 2131. The third surface 2133 of the magnet is disposed towards the second sound generating surface 2113 of the vibrating board 211. The fourth surface 2131 of the magnet is disposed opposite to the third surface 2133.

The blocker 23 includes a third side surface 231, a fourth side surface 232, a third portion 234 and a fourth portion 233. The third side surface 231 is disposed near the first sound generating surface 2111 of the vibrating board 211. The fourth side surface 232 is disposed opposite to the third side surface 231. The third portion 234 is disposed between the third side surface 231 and the fourth side surface 232 and is fixed to the cover plate 203. The fourth portion 233 is disposed between the third side surface 231 and the fourth side surface 232, is disposed opposite to the third portion 234 and is distant from the cover plate 203.

The blocker 22 includes a first side surface 221, a second side surface 222, a first portion 224 and a second portion 223. The first side surface 221 is disposed near the fourth side surface 232 of the blocker 23. The second side surface 222 is disposed opposite to the first side surface 221. The first portion 224 is disposed between the first side surface 221 and the second side surface 222 and is fixed to the cover plate 203. The second portion 223 is disposed between the first side surface 221 and the second side surface 222, is disposed opposite to the first portion 224 and is distant from the cover plate 203.

The cover plate further includes two parallel support elements 27 (FIGS. 1 and 3) and a loudspeaker containing space 2035 (FIG. 3). Each support element 27 has an end portion 271 connected to the second surface 2033 of the cover plate 203 in the vicinity of the blocker 22. The support element 27 is elongated and straddles the vibrating board 211 of the tweeter 21. In FIG. 1, two support elements 27 are provided for supporting the blocker 23. However, it is understood that the invention is not limited thereto. Any embodiments in which only one support element is provided also belong to the category of the invention. The loudspeaker containing space 2035 includes an inclined surface 2036. The tweeter 21 is fitted into the loudspeaker containing space 2035 and contacts the inclined surface 2036.

In this embodiment, the blocker 22 is placed at a side of the blocker 23, and the fourth side surface 232 of the blocker 23 is disposed towards the side where the blocker 22 is placed. Further, the blocker 22 is fixed to a depressed portion 2037 of the cover plate 203. The blocker 23 is disposed between the blocker 22 and the vibrating board 211 of the tweeter 21. The first sound generating surface 2111 of the vibrating board 211 of the tweeter 21 is disposed towards the blocker 22 and the blocker 23. It is worth noting that the blocker 23 is disposed closer to the first sound generating surface 2111 than the blocker 22.

In FIGS. 2 and 3, the width of the blocker 22 is labeled W1, the height of the blocker 22 is labeled H1, the width of the blocker 23 is labeled W2, and the height of the blocker 23 is labeled H2. The dimensions of the blockers 22 and 23 and the ratios, upper limit and lower limit thereof are shown below.

TABLE 1

| Blocker 22 | Width W1 | Height H1 | Ratio W1/H1 |
|---|---|---|---|
| Dimensions (mm) of Blocker and Ratio Thereof | 20 | 7 | 2.86 |
| Dimensions (mm) of Blocker and Ratio Thereof | 24 | 8.4 | 3.43 |
| Dimensions (mm) of Blocker and Ratio Thereof | 18 | 6.3 | 2.57 |

TABLE 2

| Blocker 23 | Width W2 | Height H2 | Ratio W2/H2 |
|---|---|---|---|
| Dimensions (mm) of Blocker and Ratio Thereof | 11 | 3.8 | 2.89 |
| Dimensions (mm) of Blocker and Ratio Thereof | 13.2 | 4.56 | 3.47 |
| Dimensions (mm) of Blocker and Ratio Thereof | 9.9 | 3.42 | 2.61 |

From the above Tables 1 and 2, it is known that the ratio of width to height of the blocker 22 ranges from 2.57 to 3.43, and the ratio of width to height of the blocker 23 ranges from 2.61 to 3.47.

Referring to FIG. 3, in this embodiment, the third surface 2133 of the magnet of the tweeter 21 and the first side surface 221 of the blocker 22 have an included angle θ1 less than ninety degrees.

When in use, the tweeter of the earpiece device is located close to user's ear so that the sound wave upon arrival at user's ear is in the form of a spherical wave. Under such circumstance, the balance between sound frequencies will be changed if the location of the ear is different. The high-pitched sound is stronger at the central part of the tweeter, while the low-pitched sound is stronger at the peripheral part of the tweeter. Therefore, when the sound wave from the peripheral part of the tweeter arrives at user's ear earlier than that from the central part of the tweeter, the balance between the high frequency sound and the low frequency sound is changed and the quality of sound is affected. To address the problem, the invention provides the blockers 23 and 22 in front of the tweeter 21. In operation, propagation of the sound wave is blocked by the blockers 23 and 22, reflection and/or diffraction of the sound wave occurs, and the propagation of the sound wave is delayed at the central part thereof. Thus, the sound wave upon arrival at the ear canal is close to a plane wave with the phase thereof adjusted. Even though different users' ears are different at locations, the invention can still keep the consistency between sound frequencies changed upon arrival at the ear canal, can stabilize the sound positioning in the front, and can provide good sound quality.

Referring to FIG. 1, the cover plate 203 of the housing 20 is provided with a plurality of acoustic holes, for example, a first acoustic hole 201 and a second acoustic hole 202. The blocker 25 is disposed adjacent to the first acoustic hole 201. The blocker 26 is disposed adjacent to the second acoustic hole 202. In operation, the woofer 24 disposed in the housing 20 (shown in FIGS. 4 and 5) generates a sound wave. The sound wave propagates out of the housing 202 through the first acoustic hole 201 and the second acoustic hole 202, and passes by the blockers 25 and 26 where reflection and/or diffraction of the sound wave occurs and the phase of the sound wave is adjusted. Thus, the sound wave upon arrival at the ear carnal is close to a plane wave.

Figure 4:
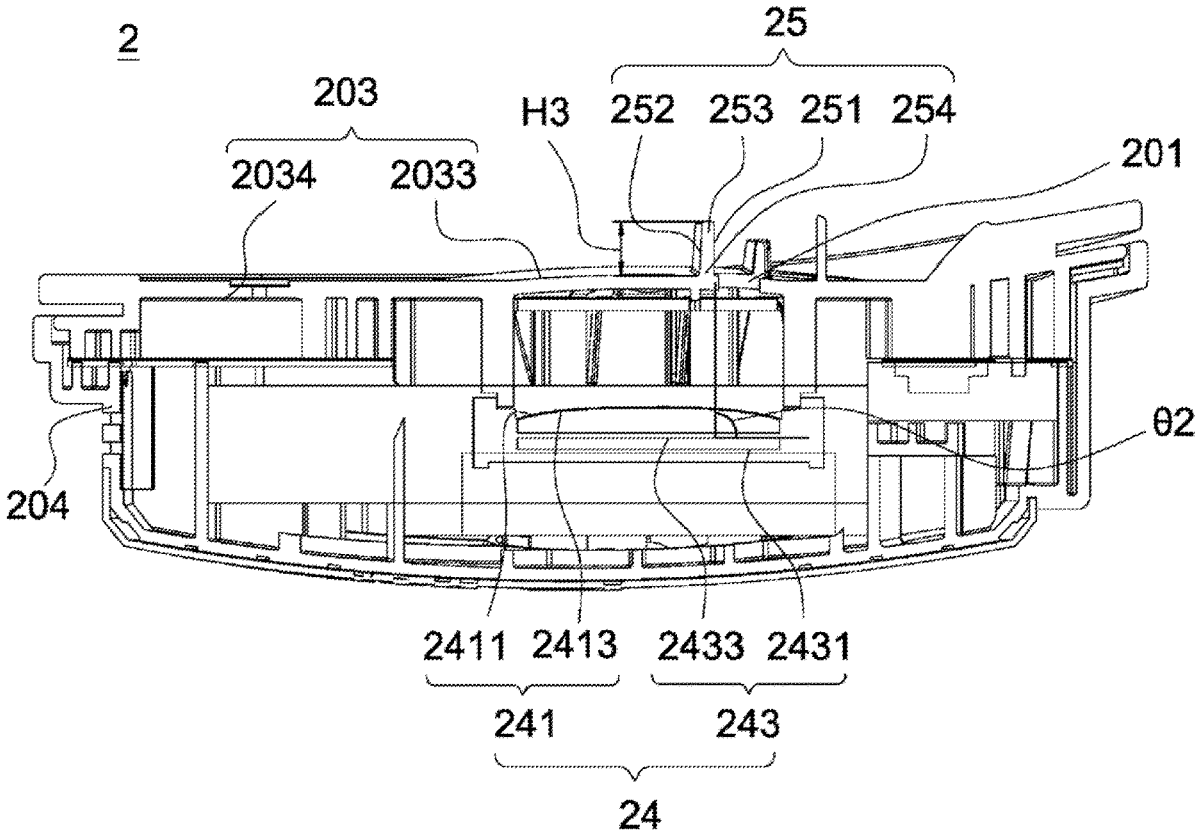
FIG. 4 is a sectional view of the earpiece device of FIG. 2 along IV-IV.

Referring to FIG. 4, FIG. 4 is a sectional view of the earpiece device of FIG. 2 along Iv-Iv. As shown, the woofer 24 includes a vibrating board 241 and a magnetic circuit 243. The vibrating board 241 includes a first sound generating surface 2411 and a second sound generating surface 2413. The first sound generating surface 2411 is disposed towards the cover plate 203. The second sound generating surface 2413 is disposed opposite to the first sound generating surface 2411. The magnetic circuit 243 is placed at a side of the vibrating board 241, and the second sound generating surface 2413 is disposed towards the side where the magnetic circuit 243 is placed. The magnetic circuit 243 includes a magnet which has a third surface 2433 and a fourth surface 2431. The third surface 2433 of the magnet is disposed towards the second sound generating surface 2413 of the vibrating board 241. The fourth surface 2431 of the magnet is disposed opposite to the third surface 2433.

The blocker 25 includes a first side surface 251, a second side surface 252, a first portion 254 and a second portion 253. The first side surface 251 is disposed near the first acoustic hole 201. The second side surface 252 is disposed opposite to the first side surface 251. The first portion 254 is disposed between the first side surface 251 and the second side surface 252 and is fixed to the cover plate 203. The second portion 253 is disposed between the first side surface 251 and the second side surface 252, is disposed opposite to the first portion 254, and is distant from the cover plate 203. In this embodiment, the third surface 2433 of the magnet and the first side surface 251 of the blocker 25 have an included angle θ2 equal to or less than ninety degrees.

In FIGS. 2 and 4, the width of the blocker 25 is labeled W3, and the height of the blocker 25 is labeled H3. The dimensions of the blocker 25 and the ratios, upper limit and lower limit thereof are shown below.

TABLE 3

| Blocker 25 | Width W3 | Height H3 | Ratio W3/H3 |
|---|---|---|---|
| Dimensions (mm) of Blocker and Ratio Thereof | 7.4 | 5 | 1.48 |
| Dimensions (mm) of Blocker and Ratio Thereof | 8.88 | 6 | 1.78 |
| Dimensions (mm) of Blocker and Ratio Thereof | 6.66 | 4.5 | 1.33 |

From the above Table 3, it is known that the ratio W3/H3 of width to height of the blocker 25 ranges from 1.33 to 1.78.

Figure 5:
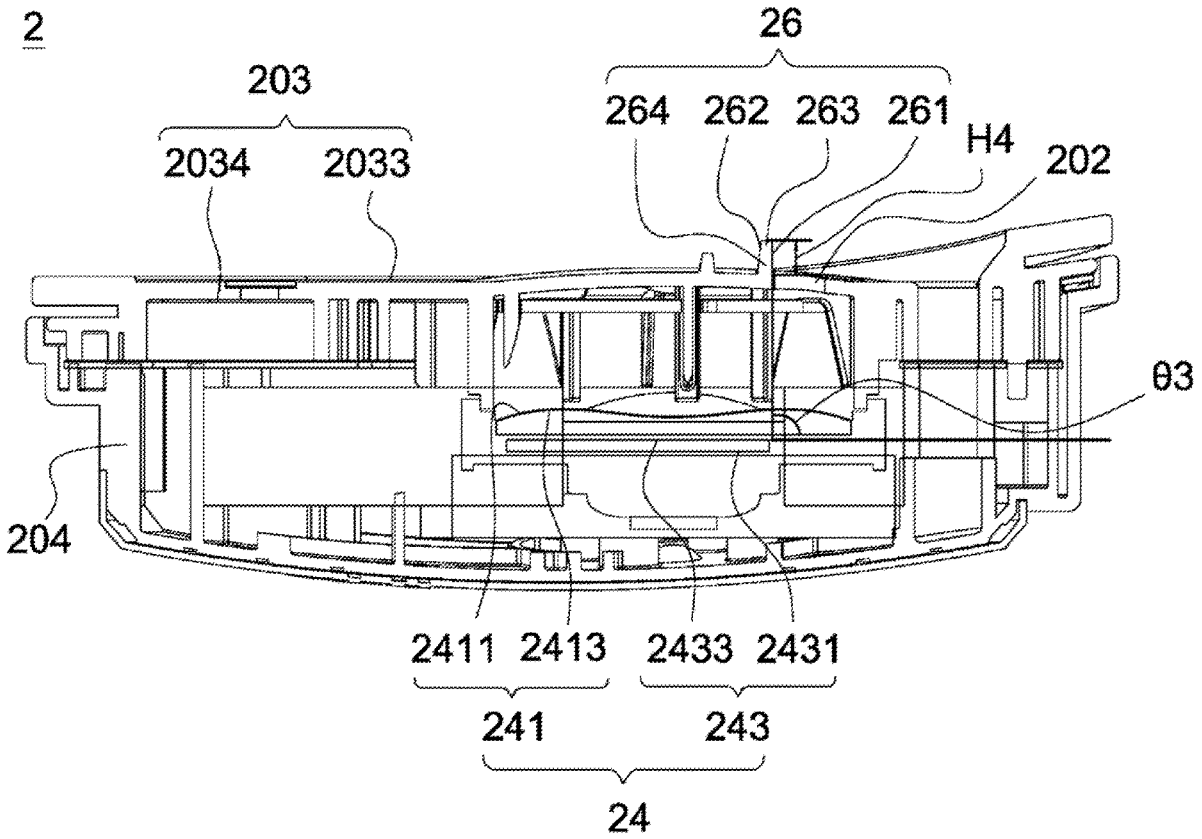
FIG. 5 is a sectional view of the earpiece device of FIG. 2 along V-V.

Referring to FIG. 5, FIG. 5 is a sectional view of the earpiece device of FIG. 2 along V-V. As shown, the blocker 26 includes a first side surface 261, a second side surface 262, a first portion 264 and a second portion 263. The first side surface 261 is disposed near the second acoustic hole 202. The second side surface 262 is disposed opposite to the first side surface 261. The first portion 264 is disposed between the first side surface 261 and the second side surface 262 and is fixed to the cover plate 203. The second portion 263 is disposed between the first side surface 261 and the second side surface 262, is disposed opposite to the first portion 264, and is distant from the cover plate 203. In this embodiment, the third surface 2433 of the magnet and the first side surface 261 of the blocker 26 have an included angle θ3 equal to or less than ninety degrees.

In FIGS. 2 and 5, the width of the blocker 26 is labeled W4, and the height of the blocker 26 is labeled H4. The dimensions of the blocker 26 and the ratios, upper limit and lower limit thereof are shown below.

TABLE 4

| Blocker 26 | Width W4 | Height H4 | Ratio W4/H4 |
|---|---|---|---|
| Dimensions (mm) of Blocker and Ratio Thereof | 8.3 | 3.5 | 2.37 |
| Dimensions (mm) of Blocker and Ratio Thereof | 9.96 | 4.2 | 2.85 |
| Dimensions (mm) of Blocker and Ratio Thereof | 7.47 | 3.15 | 2.13 |

From the above Table 4, it is known that the ratio W4/H4 of width to height of the blocker 26 ranges from 2.13 to 2.85.

The first acoustic hole 201 and the second acoustic hole 202 are disposed away from the ear carnal at different distances. The balance between the sound frequencies will be changed when the sound wave passes through the first acoustic hole 201 (closer to the ear carnal) and the second acoustic hole 202 (farther from the ear carnal) and arrives at the ear canal. The invention therefore provides the blocker 25 and the blocker 26 in front of the first acoustic hole 201 and the second acoustic hole 202 for adjusting the phase of the sound and suppressing the difference of the phase of the sound wave for the woofer 24.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An earpiece device, comprising:

a housing comprising a main body and a cover plate, wherein the cover plate comprises a first surface and a second surface, the first surface is disposed towards the main body, the second surface is disposed opposite to the first surface, and the first surface is connected to the main body so as to form an internal space of the main body, and to form an exterior which is distant from the main body;

a sound generator comprising a first loudspeaker, wherein the first loudspeaker comprises a vibrating board, the vibrating board comprises a first sound generating surface and a second sound generating surface, the first sound generating surface is disposed towards the exterior, and the second sound generating surface is disposed opposite to the first sound generating surface;

a first blocker comprising a first portion, a second portion, a first side surface and a second side surface, wherein the first side surface is disposed towards the first sound generating surface, the second side surface is disposed opposite to the first side surface, the first portion is disposed between the first side surface and the second side surface, the first portion is fixed to the cover plate, and the second portion is disposed opposite to the first portion and is distant from the cover plate; and a second blocker;

wherein the cover plate further comprises a support element, the support element comprises an end portion connected to the second surface of the cover plate, the second blocker comprises a third portion and a fourth portion, the third portion is fixed to the end portion of the support element, and the fourth portion is disposed opposite to the third portion and is distant from the end portion of the support element.

2. The earpiece device as claimed in claim 1, wherein a ratio of width to height of the first blocker ranges from 2.57 to 3.43, and a ratio of width to height of the second blocker ranges from 2.61 to 3.47.

3. The earpiece device as claimed in claim 1, wherein the sound generator further comprises a magnetic circuit, the magnetic circuit comprises a magnet, the magnet comprises a third surface and a fourth surface, the third surface of the magnet is disposed towards the second sound generating surface of the vibrating board, the fourth surface of the magnet is disposed opposite to the third surface of the magnet, and the third surface of the magnet and the first side surface of the first blocker have an included angle less than ninety degrees.

4. The earpiece device as claimed in claim 1, wherein the first blocker comprises a sound wave blocking plate.

5. The earpiece device as claimed in claim 4, further comprising a second blocker, wherein:

the cover plate defines a first acoustic hole;

the sound generator further comprises a second loudspeaker, wherein the second loudspeaker comprises another vibrating board which comprises a third sound generating surface and a fourth sound generating surface, the third sound generating surface is disposed towards the first surface of the cover plate, and the fourth sound generating surface is disposed opposite to the third sound generating surface; and the second blocker is disposed adjacent to the first acoustic hole and comprises a third portion, a fourth portion, a third side surface and a fourth side surface, wherein the third side surface is disposed close to the first acoustic hole, the fourth side surface is disposed opposite to the third side surface, the third portion is disposed between the third side surface and the fourth side surface, the third portion is fixed to the cover plate, and the fourth portion is disposed opposite to the third portion and is distant from the cover plate.

6. The earpiece device as claimed in claim 5, wherein the sound generator further comprises a magnetic circuit, the magnetic circuit comprises a magnet, the magnet comprises a third surface and a fourth surface, the third surface of the magnet is disposed towards the second sound generating surface of the vibrating board, the fourth surface of the magnet is disposed opposite to the third surface of the magnet, and the third surface of the magnet and the first side surface of the first blocker have an included angle less than ninety degrees.

7. The earpiece device as claimed in claim 5, further comprising a third blocker wherein:

the third blocker is disposed between the first blocker and the vibrating board of the first loudspeaker, the first sound generating surface is disposed towards the first blocker and the third blocker, and the third blocker is disposed closer to the first sound generating surface than the first blocker;

a ratio of width to height of the first blocker ranges from 2.57 to 3.43, and a ratio of width to height of the third blocker ranges from 2.61 to 3.47;

the sound generator further comprises a magnetic circuit, the magnetic circuit comprises a magnet, the magnet comprises a third surface and a fourth surface, the third surface of the magnet is disposed towards the second sound generating surface of the vibrating board, the fourth surface of the magnet is disposed opposite to the third surface of the magnet, and the third surface of the magnet and the first side surface of the first blocker have an included angle less than ninety degrees.

8. An earpiece device, comprising:

a housing comprising a main body and a cover plate, wherein the cover plate comprises a first surface and a second surface, the first surface is disposed towards the main body, the second surface is disposed opposite to the first surface, and the first surface is connected to the main body so as to form an internal space of the main body, and to form an exterior which is distant from the main body;

a sound generator comprising a first loudspeaker, wherein the first loudspeaker comprises a vibrating board, the vibrating board comprises a first sound generating surface and a second sound generating surface, the first sound generating surface is disposed towards the exterior, and the second sound generating surface is disposed opposite to the first sound generating surface; and a first blocker comprising a first portion, a second portion, a first side surface and a second side surface, wherein the first side surface is disposed towards the first sound generating surface, the second side surface is disposed opposite to the first side surface, the first portion is disposed between the first side surface and the second side surface, the first portion is fixed to the cover plate;

the cover plate, and the second portion is disposed opposite to the first portion and is distant from wherein the sound generator further comprises a second loudspeaker and a third loudspeaker, an projected area formed by projecting the second loudspeaker onto the cover plate has a first center, another projected area formed by projecting the third loudspeaker onto the cover plate has a second center, a line connecting the first center and the second center is perpendicularly bisected by a bisector plane, and the bisector plane passes through the first loudspeaker.

9. The earpiece device as claimed in claim 8, further comprising a second blocker, wherein the cover plate further comprises a support element, the support element comprises an end portion connected to the second surface of the cover plate, the second blocker comprises a third portion and a fourth portion, the third portion is fixed to the end portion of the support element, and the fourth portion is disposed opposite to the third portion and is distant from the end portion of the support element.

10. The earpiece device as claimed in claim 9, wherein the second blocker is disposed between the first blocker and the vibrating board of the first loudspeaker, the first sound generating surface is disposed towards the first blocker and the second blocker, and the second blocker is disposed closer to the first sound generating surface than the first blocker.

11. The earpiece device as claimed in claim 10, wherein a ratio of width to height of the first blocker ranges from 2.57 to 3.43, and a ratio of width to height of the second blocker ranges from 2.61 to 3.47.

12. An earpiece device, comprising:

a housing comprising a main body and a cover plate, wherein the cover plate defines a first acoustic hole and comprises a first surface and a second surface, the first surface is disposed towards the main body, the second surface is disposed opposite to the first surface, and the first surface is connected to the main body so as to form an internal space of the main body, and to form an exterior which is distant from the main body;

a sound generator comprising a first loudspeaker, wherein the first loudspeaker comprises a vibrating board, the vibrating board comprises a first sound generating surface and a second sound generating surface, the first sound generating surface is disposed towards the first surface of the cover plate, and the second sound generating surface is disposed opposite to the first sound generating surface; and a first blocker disposed adjacent to the first acoustic hole and comprising a first portion, a second portion, a first side surface and a second side surface, wherein the first side surface is disposed close to the first acoustic hole, the second side surface is disposed opposite to the first side surface, the first portion is disposed between the first side surface and the second side surface, the first portion is fixed to the cover plate, and the second portion is disposed opposite to the first portion and is distant from the cover plate;

wherein a ratio of width to height of the first blocker ranges from 1.33 to 1.78, or ranges from 2.13 to 2.85.

13. The earpiece device as claimed in claim 12, wherein the sound generator further comprises a magnetic circuit, the magnetic circuit comprises a magnet, the magnet comprises a third surface and a fourth surface, the third surface of the magnet is disposed towards the second sound generating surface of the vibrating board, the fourth surface of the magnet is disposed opposite to the third surface of the magnet, and the third surface of the magnet and the first side surface of the first blocker have an included angle equal to or less than ninety degrees.

14. The earpiece device as claimed in claim 12, wherein the first blocker comprises a sound wave blocking plate.

* * * * *